United States Patent [19]

Van Pelt

[11] 4,279,342

[45] Jul. 21, 1981

[54] LUNCH BOX EMPLOYING A BUILT-IN RADIO RECEIVER

[76] Inventor: Robert Van Pelt, 111 S. 3rd Ave., Highland Park, N.J. 08904

[21] Appl. No.: 132,778

[22] Filed: Mar. 24, 1980

[51] Int. Cl.[3] ..... A45C 11/20

[52] U.S. Cl. ..... 206/542; 220/20

[58] Field of Search ..... 206/542; 220/20, 23.83, 220/23.86; 224/46 R; 190/1, 43

[56] References Cited

U.S. PATENT DOCUMENTS

| | | | |
|---|---|---|---|
| 985,020 | 2/1911 | Edwards | 206/542 X |
| 3,314,739 | 4/1967 | Mendelson | 190/1 X |
| 3,871,523 | 3/1975 | Bassett | 220/20 X |
| 4,050,581 | 9/1977 | Sedlacek | 220/20 X |

*Primary Examiner*—Steven M. Pollard
*Attorney, Agent, or Firm*—Arthur L. Plevy

[57] ABSTRACT

A lunch box incorporates a radio which is positioned on a side surface and held in position by means of a flexible bracket. A side surface has a plurality of apertures for transmitting sound propagating from the radio. The front surface intermediate with the side surface has an aperture to enable a user to access control knobs positioned on the side surface of the receiver. A further aperture is covered by a clear plastic to enable a user to view the station to which the radio is tuned. The radio is retained within the lunch box by means of the above noted bracket which is lined with an insulating foam to protect the radio from the items which may be carried within the lunch box.

10 Claims, 5 Drawing Figures

LUNCH BOX EMPLOYING A BUILT-IN RADIO RECEIVER

BACKGROUND OF THE INVENTION

This invention relates to lunch boxes in general and more particularly to a lunch box having incorporated therein, a conventional radio receiver.

The prior art is replete with a number of patents which disclose various audio devices such as radios which are built in and intimately associated with other equipment. Such patents include U.S. Pat. No. 2,455,716 which shows a radio built into a bottle and essentially, the patent intends to provide a radio which has the appearance of another article. U.S. Pat. No. 2,486,536 entitled Radio Receiver Unit Mounted in a Suitcase depicts a particular technique for incorporating a radio in a suitcase or other article. Other patents as U.S. Pat. Nos. 2,795,639 and 3,836,221 depict structures for building radios into refrigerator doors or similar articles. U.S. Pat. No. 4,050,493 shows a radio which is built into a ladies' handbag.

In any event, the prior art has recognized to a certain degree that it is extremely convenient to incorporate a radio into certain articles in order for these articles to serve a dual purpose and to provide entertainment without the necessity of carrying about a separate radio.

In spite of the various structures as depicted above and probably many others, it is extremely desirable to provide a radio apparatus which is incorporated into a lunch box. Such an apparatus enables a typical user, such as a construction worker, a plant worker, a child to have the distinct advantage of being able to carry his lunch, while further having a built-in radio which is carried along without any extra inconvenience.

In any event, in implementing such a design, it is extremely important that the radio be mounted in a lunch box so as to be capable of proper operation, while further being properly insulated and protected against the typical substances which are found in a lunch box. The structure must be capable of being easily implemented, while the radio must be capable of being easily removed for the replacement of batteries and repair.

It is therefore an object of the present invention to provide a lunch box employing a built-in radio receiver which is simple and economical to construct and which offers great versatility to a user.

BRIEF DESCRIPTION OF THE PREFERRED EMBODIMENT

A lunch box radio apparatus comprising a rigid box-like assembly having a bottom surface, first and second side surfaces, a front surface and a rear surface to form a box-like assembly having an internal hollow with a top open surface, one of said side surfaces as positioned between said front and rear surfaces having a plurality of sound emitting apertures located thereon, with said front surface having an aperture near said one side surface, a radio receiver positioned in said hollow and held adjacent said one side surface with a surface of said radio in proximity with said apertures, and at least one control knob positioned adjacent said aperture in said front surface to enable a user of said lunch box to operate said radio via said aperture, and a cover member pivotally coupled to said rear surface for selectively covering and exposing said top open surface, whereby said radio can be operated by said user independent of the position of said cover member.

DETAILED DESCRIPTION OF THE INVENTION

Figure 1:
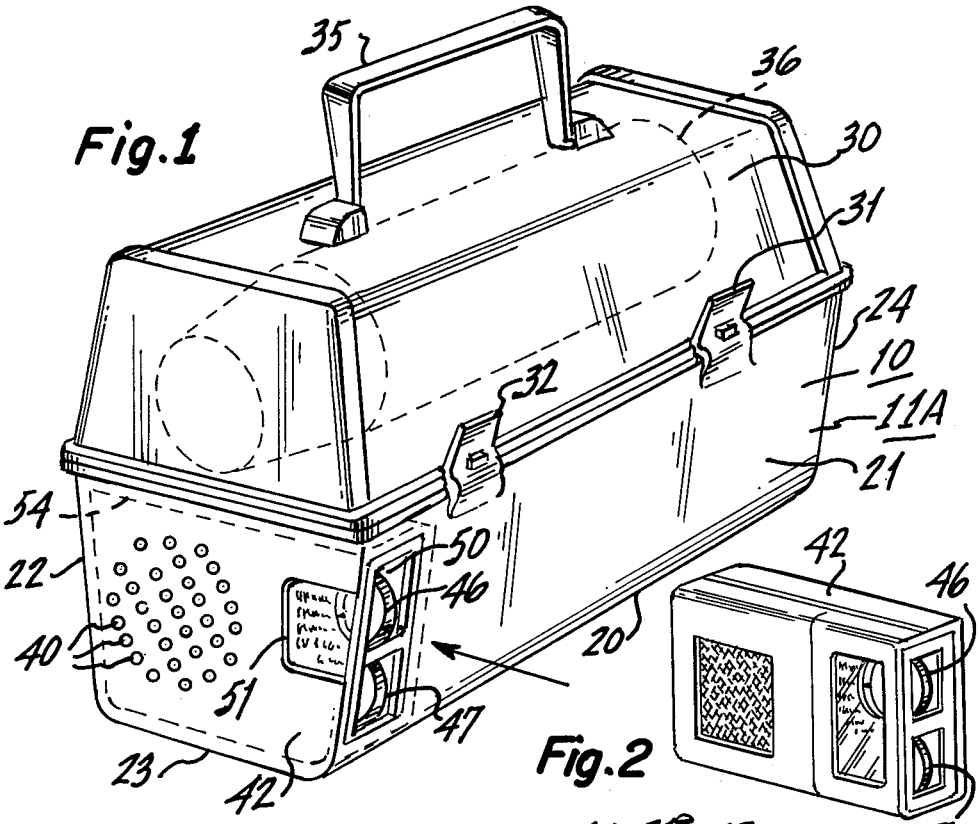
FIG. 1 is a perspective plan view of a lunch box radio apparatus according to this invention.

Referring to FIG. 1, there is shown a typical lunch box structure 10. Essentially, the lunch box 10 is a common type of lunch box, which consists of a box-like bottom section 11A having a closed bottom surface 20, a front surface 21, a rear surface 22 and an open top. The side surfaces 23 and 24 are conventionally disposed between the front surface 20 and the rear surface 22.

A top portion of the lunch box 30 is an inverted box-like structure and is coupled at the back surface 22 to the bottom section 11A by means of a hinge arrangement (not shown). Two clips as 31 and 32 serve to close the top portion 30 with respect to the bottom portion 11A to secure the contents contained in the lunch box. The top section 30 of the lunch box typically includes a handle 35 to enable a user to conveniently carry the lunch box and its contents.

In the particular configuration of the lunch box 10 depicted in FIG. 1, there is shown a thermos bottle 36 positioned in the top section 30 and retained therein by means of a suitable bracket. As indicated, such lunch box configurations are extremely typical and a suitable structure is presently manufactured by the King Seeley Thermos Company of Norwich, Conn. as Model No. 0770-07110-1.

Such lunch boxes as 10 are conventionally fabricated from a strong plastic material which also serves as an insulator. Essentially, food items such as sandwiches, fruit are contained in the bottom box-like section 11A, while a suitable beverage is contained in the thermos 36. It is well known that the items can cause liquids to spill as well as particles of food and so on to be exposed within the internal hollow of the lunch box.

Shown in FIG. 1 is a plurality of apertures 40 which are formed in the side surface 23 of Section 11A. The apertures are arranged in a circular pattern, but any other geometrical configuration will suffice. Located within the internal hollow of the box-like section 11A is a radio receiver 42. Essentially, the radio receiver 42 is of a conventional configuration and many such receivers are presently available on the market such as a device manufactured by Audition Co. of Hong Kong, Model No. 175.

The radio receiver has two control knobs 46 and 47. The knob 46 operates the tuning mechanisms of the receiver to enable a user to tune to any desired station, while the knob 47 is a combination on/off and volume control.

Figure 2:
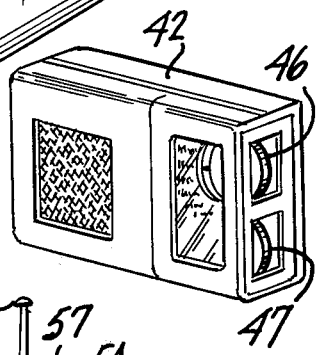
FIG. 2 is a plan view of a typical radio receiver used with this invention.

Essentially, the particular radio configuration employed in this invention is shown in FIG. 2. The radio 42 is manufactured by many, many companies and is of a conventional configuration employing control knobs as 46 and 47 on the side surface and being relatively rectangular in configuration.

As seen from FIG. 1, there is a rectangular aperture 50 located in the front surface 21 of the bottom section 11A. The aperture 50 allows a user to operate the control knobs 46 and 47.

Located on the side surface 23 is an aperture 51 which may be contiguous with aperture 50 and formed in the side surface by the same stamping process or by a suitable molding process. The aperture 51 is covered by a clear transparent plastic panel to enable a user to view the tuning indications associated with the movement of the tuning knob 46. In this manner, the user can see the station that he is tuned to via aperture 51.

The radio 42 is held adjacent to the side panel 53 by means of a flexible upstanding flange 54. The flange is insulated and essentially has a top and side surface which completely encloses the radio and protects the same from liquid spills or other particles which may be found in a lunch box container.

Figure 3:
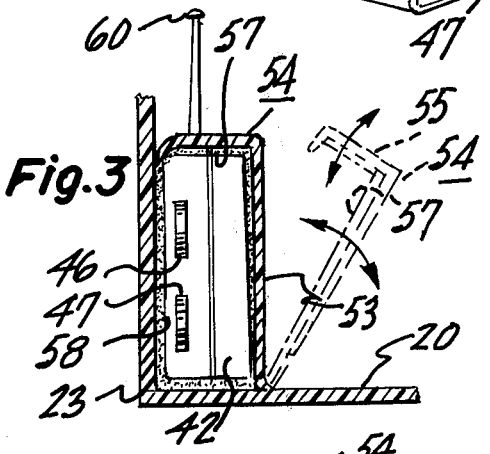
FIG. 3 is a partial cross sectional view depicting a flexible bracket for securing the radio.

Referring to FIG. 3, there is shown a partial section to depict operation of the flange 54 in conjunction with the radio receiver 42. The flange 54 is of an inverted L-shaped configuration with the bottom arm of the flange secured to the bottom surface 20. As can be seen, the flexible flange 54 has an upstanding arm 53 which tapers in thickness from the top to the bottom and hence, forms a flexible hinge-like member at the bottom surface 20 of the lunch box. The bracket 54 may be integrally formed during fabrication of the lunch box or may be a separate piece and secured to the lunch box by conventional means such as clips, a suitable bonding process and so on.

Figure 4:
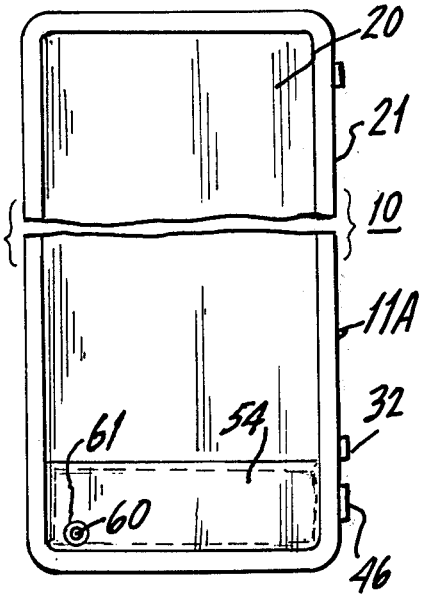
FIG. 4 is a top plan view of a lunch box compartment containing the radio.

The top arm 55 of the L-shaped bracket 54 extends towards the side surface 23. The bracket 54 is directed along the entire width of the lunch box as shown in FIG. 4 which is a top view looking into section 11A with the cover member 36 removed.

The bracket 54 has its inner surface covered with a thick layer of a flexible insulating material 57 such as a urethane foam. In this manner, the urethane foam acts both as a cushion for the radio as well as an insulator. A layer of urethane foam 58 is also positioned between the front surface of the radio and the inner surface of the side 23. This layer may have apertures located therein corresponding to apertures 40. In any event, this is not necessary as the form will permit sound to propagate directly from the radio via the apertures 40 in the side surface 23. Hence, the foam protects the radio from the external environment outside the lunch box, while both the flange bracket 54 and the inner foam coating 57 protect the radio from the inner contents.

As shown in FIG. 3, the flange, based on its tapered arm 57 and as fabricated from a flexible material, can be pivoted as shown. The top arm 55 can also be pivoted and hence, the entire radio can be removed by the user in a simple and reliable operation. This will enable convenient battery replacement or servicing of the radio or to enable a user to remove the radio from the lunch box, if so desired. The flange 54 also permits one to use a radio as 42 of the general configuration shown with widely varying dimensions as the protruding foam layer 57 is thick enough to accommodate many different receiver designs, all of which can be retained by the bracket 54 within the dimensions of the typical lunch box.

Figure 5:
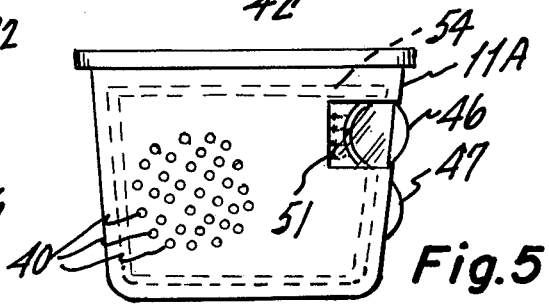
FIG. 5 is a side view of the apparatus according to this invention.

FIG. 5 depicts a side view of the bottom section 11A wherein like parts have been designated by the same numerals to clearly show the nature of the window 51 as enabling a user to view the turning or station indications depicted on the radio.

Essentially, it has been determined that a radio positioned as shown in the lunch box will enable a user to receive typical AM transmissions without the necessity of turning the lunch box. Based on the position of the radio adjacent the sidewall of the lunch box, the user's body does not interfere with typical reception as it would if the radio were located in a front or a rear surface.

FIG. 3 also shows an antenna 60 of the telescoping type directed from the radio receiver 42. Antenna 60 can be used for FM reception if the radio receiver 42 is a combination AM/FM device. In this manner, a slot 61 would be included on the top surface of the bracket 54 to enable the antenna to be extended or retracted as desired.

As above indicated, a typical lunch box 10 is fabricated from a plastic, which is impervious to radio transmissions and hence, radio waves will propagate through the structure to enable reception by the receiver. If the lunch box were fabricated from some other material such as metal, the antenna leads of the radio could be connected directly to the lunch box and hence, the metal enclosure would serve as an antenna in the case of AM transmissions. For an FM transmission, the antenna 60 can also be employed with a metal lunch box.

As one can ascertain, the construction of the combination lunch box radio is extremely simple and the apertures as 50, 51 and 40 can be punched or formed during the molding process. The bracket 54 covers the radio and based on the foam insulation, further prevents liquids or particles from interfering with the radio operation, while further assuring that the radio can be easily removed and replaced as desired.

In summation, the lunch box combination above described offers great utility to both a manufacturer and a user, as the user has all the advantages of the lunch box, while further being provided with the entertainment afforded by a radio. In this manner, a user can employ the radio during a lunch break or use it while going or coming from school or work. The volume occupied by the radio is insignificant and hence, the overall volume of the lunch box structure is not adversely affected. The radio is protected both from the contents of the lunch box by the insulating foam layers as well as from the external environment via the foam layer which is disposed over the apertures 40. It is thus apparent that the structure has widespread utility both from the manufacturer's and the consumer's point of view.

I claim:

1. A lunch box radio apparatus, comprising:

(a) a rigid box-like assembly having a bottom surface, first and second side surfaces, a front surface and a rear surface to form a box-like assembly having an internal hollow with a top open surface, one of said side surfaces as positioned between said front and rear surfaces having a plurality of sound emitting apertures located thereon, with said front surface having an aperture near said one side surface, (b) a radio receiver positioned in said hollow and held adjacent said one side surface with a surface of said radio in proximity with said apertures, and at least one control knob positioned adjacent said aperture in said front surface to enable a user of said lunch box to operate said radio via said aperture, and (c) a cover member pivotally coupled to said rear surface for selectively covering and exposing said top open surface whereby said radio can be operated by said user independent of said cover member.

2. The lunch box radio apparatus according to claim 1, further including bracket means comprising a flexible "L" shaped member coupled to said bottom surface within said hollow and located a predetermined distance from said one side surface with one arm of said "L" secured to said bottom surface and said other arm extending towards said side surface for extending over the top surface of said radio as positioned in said hollow to retain said radio in a desired position with respect to said aperture on said front surface.

3. A lunch box apparatus comprising:

(a) a rigid box-like assembly having a bottom surface, first and second side surfaces, a front surface and a rear surface to form said box-like assembly having an internal hollow with a top open surface, one of said side surfaces as positioned between said front and rear surfaces having a plurality of sound emitting apertures located thereon, with said front surface having an aperture near said one side surface, (b) a flexible "L" shaped member coupled to said bottom surface within said hollow and located a predetermined distance from said one side surface with one arm of said "L" secured to said bottom surface and said other arm extending towards said side surface, (c) a radio receiver positioned in said hollow between said side surface and said "L" shaped member, with said other arm extending over the top surface of said radio to retain the same in position, said radio having at least one control knob positioned to be accessed via said aperture in said front surface to enable a user of said lunch box to operate said radio, (d) a cover member pivotally coupled to said box-like assembly for selectively covering and exposing said top open surface.

4. The lunch box apparatus according to claim 3 further including an insulating layer located with said hollow to cover said side surface, with said layer having corresponding apertures for enabling sound to propagate.

5. The lunch box apparatus according to claim 3 further including an insulating material positioned about the inner surface of said "L" shaped member as facing said side surface.

6. The lunch box apparatus according to claim 3 wherein said control knob is a combination on-off volume control.

7. The lunch box apparatus according to claim 3 further including a clear window located on said one side surface in close proximity to said front surface for allowing a user to view a tuning indicator associated with said radio receiver.

8. The lunch box apparatus according to claim 3 wherein said rigid box-like structure is fabricated from a plastic of the type impervious to the transmission of radio waves.

9. The lunch box apparatus according to claim 3 further including antenna means located on said radio receiver adapted to receive F.M. transmissions.

10. The lunch box apparatus according to claim 9 wherein said flexible "L" shaped member has an aperture on said other arm for surrounding said antenna.

* * * * *